United States Patent [19]

Gasser

[11] Patent Number: 4,999,877

[45] Date of Patent: Mar. 19, 1991

[54] SAFETY DEVICE FOR A FURNITURE HINGE ASSEMBLY

[75] Inventor: Ingo Gasser, Hochst/Vlbg., Austria

[73] Assignee: Grass AG, Hochst/Blvg., Austria

[21] Appl. No.: 527,089

[22] Filed: May 22, 1990

[30] Foreign Application Priority Data

Jun. 8, 1989 [DE] Fed. Rep. of Germany ... 8907048[U]

[51] Int. Cl.[5] ..... E05D 7/12

[52] U.S. Cl. ..... 16/258; 16/DIG. 43

[58] Field of Search ..... 16/257, 258, 260, DIG. 43

[56] References Cited

U.S. PATENT DOCUMENTS 4,430,771 2/1984 Salice ..... 16/DIG. 43

4,760,623 8/1988 Toyama ..... 16/258

4,881,297 11/1989 Grass ..... 16/258

*Primary Examiner*—Richard K. Seidel

*Assistant Examiner*—Carmine Cuda

[57] ABSTRACT

A hinge mechanism of the type comprising a base plate securable to a furniture carcass, a mounting plate releasably secured to the base plate by a retaining lever and an adjusting plate adjustably securing a hinge arm or a cover bracket to the mounting plate is provided with a safety insert to prevent accidental release of the mounting plate from the base plate. The insert comprises a block having a projection which extends into a space between the adjusting plate and the mounting plate and a channel which receives an actuating branch of the retaining lever to lock it against movement. The insert is shaped to fit tightly between one surface of the adjusting plate and an outer cylindrical surface of a sleeve spring which biases the lever into its engaging position.

12 Claims, 1 Drawing Sheet

SAFETY DEVICE FOR A FURNITURE HINGE ASSEMBLY

BACKGROUND OF THE INVENTION

1. FIELD OF THE INVENTION

This invention relates to a safety device for a furniture hinge assembly of the type used for mounting a door on a furniture carcass, and is particularly concerned with hinge assemblies of the type wherein a base plate is secured to the furniture carcass and the main part of the hinge mechanism is secured to the door and then releasably secured to the base plate by means of a mounting plate to which a hinge arm is secured through suitable adjusting means.

2. DESCRIPTION OF THE PRIOR ART

A hinge assembly of the above type is disclosed in U.S. Pat. No. 4,881,297 to Grass dated Nov. 21, 1989, which is hereby incorporated herein by reference. The hinge assembly of U.S. Pat. No. 4,881,297 comprises:

- a base plate having means for attachment to a furniture carcass;
- a mounting plate releasably attached to the base plate;
- a hinge arm or cover bracket secured to the mounting plate via adjusting means and carrying the actual hinge mechanism on which the door is hung; and
- a spring-mounted retaining lever held on the mounting plate and engaging the base plate with a snap fit to retain the mounting plate on the base plate. The retaining lever is in the form of a rocker and has a projecting branch which can be used to release the lever manually from its engagement with the base plate and thus to allow the hinge mechanism to be detached from the base plate.

With this known arrangement, there is a risk that the mounting plate may be unintentionally released from the base plate by accidental knocking or catching of the projecting branch of the spring-loaded lever.

SUMMARY OF THE INVENTION

It is accordingly an object of the present invention to provide a hinge assembly of the aforementioned type in which the risk of accidental detachment of the mounting plate from the base plate is avoided.

It is a further object of the invention to provide an insert which can be used to prevent accidental knocking or catching of the projecting branch of the retaining lever in a hinge assembly.

These objects are attained in accordance with the present invention in that in a hinge assembly of aforementioned type a safety insert is provided in the form of a block having a channel therein to receive the projecting branch of the retaining lever and a projection which engages in a space between the mounting plate and an adjusting plate of the hinge mechanism, in which the retaining lever and its spring biasing means are accommodated, to lock the lever against actuation. The projecting branch of the lever thus cannot be actuated to disengage the mounting plate without first removing the insert.

To ensure easy insertion of the safety insert of the invention, the projection on the insert preferably has a flat outer surface to engage a corresponding surface on the adjusting plate of the hinge mechanism, a surface parallel thereto being provided within the channel on the side thereof opposite to the projection, to engage a corresponding flat surface of a straight terminal portion of the projecting branch of the lever. To ensure secure retention of the insert, an elongate rib is preferably provided in the channel adjacent said flat surface, to engage a corresponding shallow elongate recess or channel in the lever branch.

The flat surface of the insert which engages the corresponding surface within the hinge mechanism may also be provided with serrations to engage corresponding serrations on the abutting surface of the adjusting plate, to assist in retaining the insert in position.

The lever is preferably biased into its retaining position by a cylindrical sleeve spring, and the safety insert preferably has, between its projection and the channel which receives the projecting branch of the lever, a part-cylindrical surface which abuts the outer surface of the sleeve spring, the part-cylindrical surface being coaxial with, and having the same radius as, the sleeve spring. This surface preferably abuts the sleeve spring over an angle of approximately 90°.

The depth of the channel in the insert preferably corresponds approximately to the length of the projecting branch of the retaining lever, so that the bottom of the groove also acts as a stop. The channel preferably has a widened opening for ease of insertion, one surface of the outer section of the groove being at an oblique angle to the innermost portion of the groove to bear against a correspondingly angled portion of the lever.

The insert is preferably made from a suitable plastics material which can be injection molded. It preferably has a widened shoulder at its outer end to facilitate gripping for insertion and removal.

The retaining lever is preferably made from resilient strip metal.

Further objects and advantages of the invention will become apparent from the following specific description when read in conjunction with the accompanying drawings which illustrate a preferred embodiment of the invention.

DETAILED DESCRIPTION OF THE PREFERRED EMBODIMENT

Figure 2:
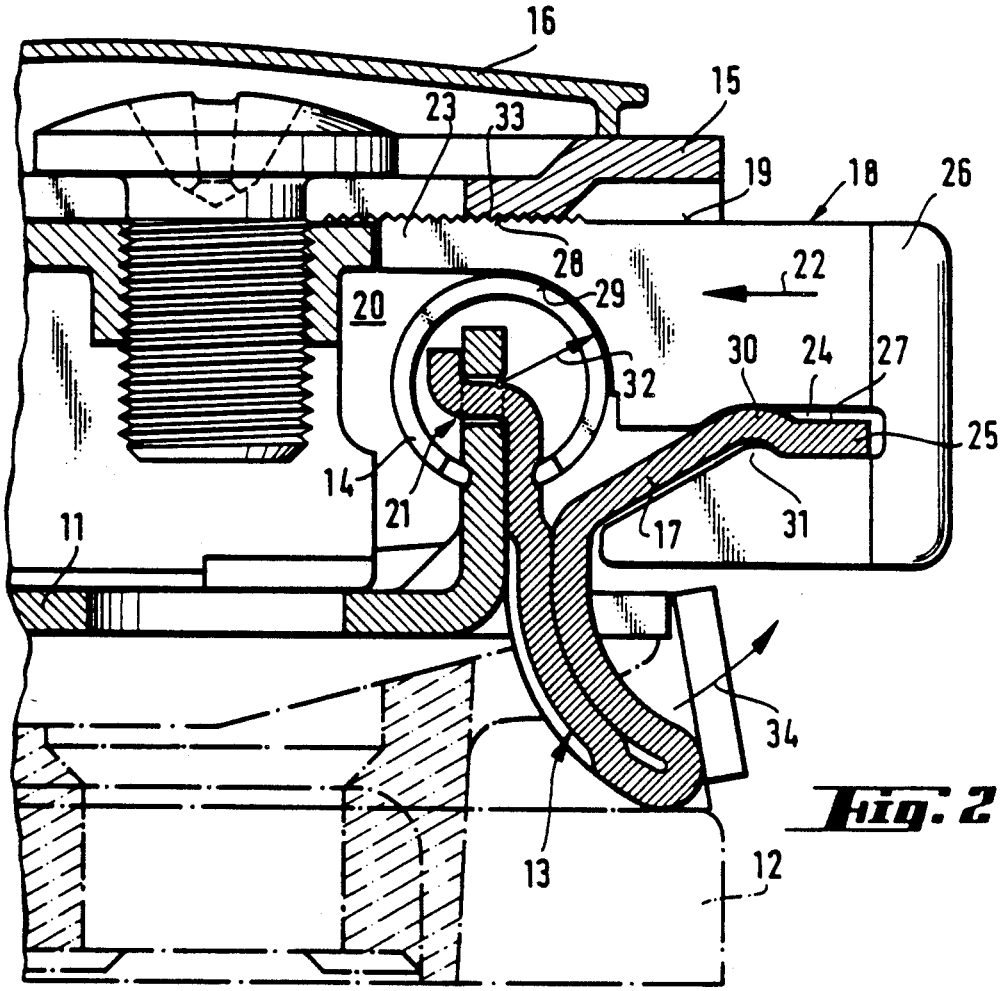
FIG. 2 shows an enlarged plan view of the safety insert of FIG. 1, in position in a hinge assembly, a part of which is shown, partly in cross-section.

Referring first to FIG. 2, there is shown in plan view, partly in section, one end of a hinge assembly of the same general type as that disclosed in U.S. Pat. No. 4,881,297. The hinge assembly comprises a base plate 12 having a pair of screw holes therethrough for securing it to an inner surface of a furniture carcass. Only one of the screw holes is shown in FIG. 2.

The end of the hinge assembly shown in FIG. 2 is that which will normally be positioned furthest inside the furniture carcass, remote from the door hung on the hinge.

A mounting plate 11 is secured to the base plate 12. The end of the mounting plate which is not shown in FIG. 2 is provided with hooked portions which engage over corresponding flanges of the base plate. At the opposite end, shown in FIG. 2, the mounting plate has oblique flanges which abut corresponding end surfaces of the base plate. The mounting plate is retained in this position by a spring-loaded retaining lever 13, as will be described in more detail below.

An adjusting plate 15 and covering bracket 16, to which is secured the main part of the hinge mechanism (not shown) are adjustably secured to the mounting plate 11 by screws. Between the adjusting plate 15 and mounting plate 11 there is defined a space 20 which receives the mechanism by which the mounting plate is secured to the base plate.

The mounting plate 11 has an end flange turned upwards (as seen in the drawing) to project into the space 20. The retaining lever 13, shown in cross-section in FIG. 2, has a hooked portion 21 which engages through an aperture in the end flange to form a pivoting connection. This connection is surrounded by a cylindrical sleeve spring 14 which biases the lever 13 in a clockwise direction towards the retaining position shown in FIG. 2.

The central portion of the retaining lever has lateral wings which engage corresponding projections of the base plate 12, as described in U.S. Pat. No. 4,881,297, with a snap fit to lock the mounting plate into engagement with the base plate. The lever is made from a resilient material, suitably sheet metal, which as shown in the drawing is doubled over in its central portion. One outer edge forms the pivotal connection at 21 while the opposite edge of the strip is bent outwardly to form an actuating branch 17 which projects outwardly from the reception space 20.

To release the mounting plate from the base plate, the actuating branch 17 of the lever is lifted as shown in FIG. 2, to pivot the lever in the direction of arrow 34, against the bias of the sleeve spring 14. This disengages the lever from the base plate 12.

Figure 1A:
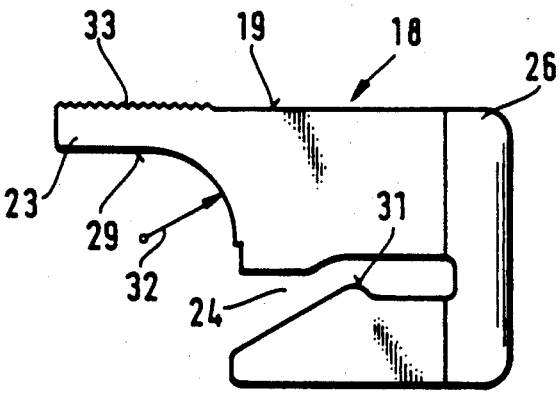
FIG. 1*a* shows a plan view of a safety insert in accordance with the present invention.
Figure 1B:
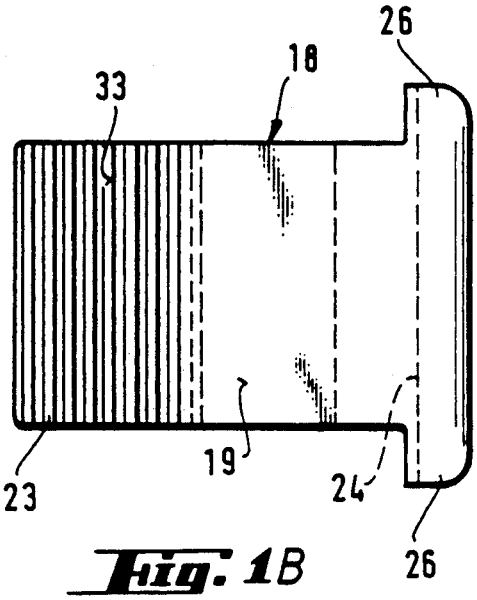
FIG. 1*b* shows a side elevation of the safety insert of FIG. 1.

To prevent accidental actuation of the lever branch 17, a safety insert 18 is provided as illustrated in FIGS. 1*a* and 1*b* and shown in position in FIG. 2. The insert comprises a block of plastics material, suitably injection molded, having a generally rectangular main portion with a projection 23 formed along one edge and forming a continuation thereof. The insert also has an elongate channel 24 extending across its width.

Referring again to FIG. 2, when the insert 18 is in position its forward projection 23 extends into the space 20 between the inner surface 28 of the adjusting plate 15 and the outer surface of the cylindrical sleeve spring 14. The surface of the projection which engages the adjusting plate 15 is flat and formed as a continuation of the flat outer surface 19 of the insert. Serrations 33 may be provided on this outer surface of the projection, to engage corresponding serrations on the opposing surface of the adjusting plate, to retain the insert more securely. The leading end of the projection 23 abuts a corresponding inner surface of the adjusting plate.

The side of the projection opposite to the flat side 19 merges into a concave part-cylindrical surface 29 having the same radius 32 as the outer surface of the sleeve spring 14, and engages this outer surface over 90°. There is thus provided a tight fit allowing little or no movement of the insert in the space 20.

The projecting portion 17 of the lever 13 is received within the channel 24 as shown in FIG. 2. The innermost portion 27 of the channel 24 has its sides parallel to the outer surface 19 of the insert, and one of these surfaces, the bottom one as shown in FIG. 2, abuts a corresponding surface of the outermost end 25 of the lever branch, which is straight. Adjacent the end 25, the lever branch has a curved portion 30 defining a shallow channel in which engages a corresponding rib 31 on the inner surface of the channel 24. The opposite side of the channel 24 is also curved at this point to match the opposing surface of the lever branch.

Between the curved portion 30 and the central part of the lever, the lever branch 17 has a straight portion at an oblique angle to the end portion 25, which runs parallel to a corresponding flat surface of the insert at the mouth of the channel 24.

The safety insert 18 is inserted in position simply by pushing it into the space 20 in the direction of arrow 22 so that the projection 23 enters between the sleeve spring 14 and the opposing surface 28 of the adjusting plate 15 and the lever branch 27 enters the channel 24. As the position shown in FIG. 2 is reached, the lever branch 17 engages in the channel 24 with a snap fit owing to its own resilience and that of the insert. The partcylindrical surface 29 of the insert meanwhile comes into abutment with the sleeve spring 14 and the serrations 33 on the opposing surfaces 19 and 28 engage one another to ensure a tight and secure fit. Since the lever branch 17 engages snugly within the channel 24, and the insert 18 cannot itself move within the space 20 other than being pulled directly out of it, it can be seen that there is no possibility of accidental actuation of the lever branch 17 to release the mounting plate 11 from the base plate 12.

The insert 18 has at its outer end a widened shoulder 26 to facilitate gripping, so that it can be pulled out when required to enable the retaining lever 13 to be disengaged to detach the hinge mechanism from the base plate.

What is claimed is:

1. In a furniture hinge assembly comprising:

a base plate having means for securing it to a furniture carcass;

a mounting plate releasably secured to said base plate;

a retaining lever engaging said mounting plate and securing it releasably to said base plate;

an adjusting plate adjustably connecting a hinge mechanism to said mounting plate, a space being defined between said adjusting plate and said mounting plate;

a pivotal connection within said space between said lever and said mounting plate;

spring means located within said space, biasing said lever into an engaging position; and an outwardly extending branch of said lever, actuable against the bias of said spring to disengage said lever from said base plate, an improvement comprising a safety insert locatable and retainable in said space, said insert comprising a block having a channel therein to receive said branch of said lever and a projection thereon to engage between said spring means and a surface of said adjusting plate, thereby preventing actuation of said branch when said insert is located in said space.

2. A furniture hinge assembly as claimed in claim 1 wherein said block is of generally rectangular cross section.

3. A hinge assembly as claimed in claim 1 wherein the depth of said channel corresponds approximately to the projecting length of said actuating branch of said lever.

4. A hinge assembly as claimed in claim 1 wherein said insert has a widened outer portion forming a shoulder to facilitate gripping for insertion and removal.

5. A hinge assembly as claimed in claim 1 wherein said insert is made from plastics material.

6. A hinge assembly as claimed in claim 1 wherein said retaining lever is formed from resilient sheet metal.

7. A hinge assembly as claimed in claim 1 wherein said projection on said insert has a flat outer surface formed as a continuation of a side surface of said block, and engages in full surface contact with a corresponding surface of said adjusting plate.

8. A hinge assembly as claimed in claim 7 wherein serrations are formed on said flat surface of said projection and on the surface of the adjusting plate which it engages, for secure retention of said insert in said space.

9. A hinge assembly as claimed in claim 7 wherein said spring means comprises a cylindrical sleeve spring surrounding said pivotal connection and wherein said projection has a surface opposite to said side surface which merges into a concave part-cylindrical surface having the same radius as said sleeve, and engages said sleeve spring over an angle of 90° when the safety insert is fully inserted in said space.

10. A hinge assembly as claimed in claim 7 wherein said channel has an innermost portion defined between an opposed pair of flat surfaces substantially parallel to said flat outer surface of said projection, and wherein said actuating branch of said lever has a substantially straight end portion received in said innermost portion of the channel with one flat surface thereof in full surface contact with the side of the channel furthest from said projection.

11. A hinge assembly as claimed in claim 10 wherein the actuating branch of the lever has, adjacent its straight end portion, a curved portion defining a shallow channel which receives a correspondingly shaped rib on the inner surface of said channel, to provide a snap fit of the lever branch in the channel.

12. A hinge assembly as claimed in claim 10 wherein said channel has an outer portion one surface of which extends obliquely to said innermost portion and wherein the actuating branch of the lever has a corresponding portion extending obliquely to said straight end portion and following said oblique surface of the channel.

* * * * *